US005627224A

United States Patent [19]

Lyrmalm et al.

[11] Patent Number: 5,627,224

[45] Date of Patent: May 6, 1997

[54] AQUEOUS COMPOSITIONS FOR SIZING OF PAPER

[75] Inventors: Ebbe Lyrmalm, Kungälv, Sweden; Bruno Carré, Grenoble, France

[73] Assignee: Eka Nobel AB, Sweden

[21] Appl. No.: 367,118

[22] PCT Filed: Jun. 17, 1993

[86] PCT No.: PCT/SE93/00541

§ 371 Date: Jan. 6, 1995

§ 102(e) Date: Jan. 6, 1995

[87] PCT Pub. No.: WO94/01619

PCT Pub. Date: Jan. 20, 1994

[30] Foreign Application Priority Data

Jul. 7, 1992 [SE] Sweden ..... 9202106

[51] Int. Cl.[6] ..... C08K 3/10

[52] U.S. Cl. ..... 524/52; 524/437; 524/548; 524/555

[58] Field of Search ..... 524/52, 437, 548, 524/555

[56] References Cited

U.S. PATENT DOCUMENTS

| | | | |
|---|---|---|---|
| 4,533,434 | 8/1985 | Yoshioka et al. | 162/124 |
| 4,816,073 | 3/1989 | Helmer et al. | 106/238 |
| 5,145,522 | 9/1992 | Nakagawa et al. | 106/243 |
| 5,167,849 | 12/1992 | Seeholzer et al. | 252/60 |

FOREIGN PATENT DOCUMENTS

| | | |
|---|---|---|
| 0220941 | 5/1987 | European Pat. Off. . |
| 0293119 | 11/1988 | European Pat. Off. . |
| 0327215 | 8/1989 | European Pat. Off. . |
| 0341509 | 11/1989 | European Pat. Off. . |
| 0369328 | 5/1990 | European Pat. Off. . |
| 0432838 | 6/1991 | European Pat. Off. . |
| 59-199900 | 11/1984 | Japan . |
| 5919900 | 11/1984 | Japan . |
| 59/199900 | 11/1984 | Japan . |
| 3/279498 | 12/1991 | Japan . |

OTHER PUBLICATIONS

Hernandez, H.R., "Amphoteric Waxy Maize Starch use in Alkaline Papers" EUCEPA 24th Cont. Proc. (Stockholm), Pap Technol.: 186–195 (May 8–11, 1990).

Hernandez, H.R., "Amphoteric Waxy Maize Starch Use In Alkaline Papers", *EUCEPA* 24th Cont. Proc. (Stockholm), Pap. Technol.: 186–195, May 8–11, 1990.

International Search Report for International Application No. PCT/SE 93/00541.

*Primary Examiner*—Jeffrey T. Smith

*Attorney, Agent, or Firm*—Ralph J. Mancini; Louis A. Morris

[57] ABSTRACT

The present invention provides a paper sizing composition which comprises a sizing agent selected from cyclic dicarboxylic acid anhydride or alkyl ketene dimer, a stabilizing and/or dispersing agent which is an amphoteric polymer and a polyaluminum compound.

16 Claims, No Drawings

AQUEOUS COMPOSITIONS FOR SIZING OF PAPER

The present invention relates to water based compositions of synthetic cellulose-reactive sizing agents, which are alkyl ketene dimers or cyclic dicarboxylic acid anhydrides and more particularly to such compositions which contain an amphoteric polymer and a polyaluminium compound.

Alkyl ketene dimers (AKD) and cyclic dicarboxylic acid anhydrides, particularly alkenyl succinic anhydride (ASA), are to a great extent used for paper sizing, hydrophobing, at neutral or alkaline pH. The compounds are cellulose reactive and bind directly to the hydroxyl groups in the cellulose. The commercially used products are usually stabilized with cationic starch which also contributes to retention of the sizing agent. Separate additions of retention agents and other chemicals to the stock are often also used to increase retention and to improve the sizing. It is known to use the sizing agents in combination with aluminium compounds. Small amounts of alum are often used for ASA-emulsions, either in the emulsion or as separate stock addition, primarily to decrease the deposition problems which are connected with this. The production of sized paper by stock addition of cationic AKD-dispersion, high cationized starch and water soluble aluminium salt is described in the Japanese patent application 84-199900. It is also known from the German patent application 4090740 to incorporate a polyaluminium compound in dispersions of AKD and cationic dispersing agent such as cationic starch. D-based sizing compositions are comparatively expensive due to the costs for the ketene dimer as such and the development is thus directed to production of dispersions which give the best sizing with the lowest amount of AKD. Requirements are of course also made on the dispersions as such with regard to stability and satisfactory high dry contents.

According to the present invention it has been found that water based compositions of ketene dimers or cyclic dicarboxylic acid anhydrides which comprise both an amphoteric polymer and a polyaluminium compound give very good sizing with low amounts of the sizing agent since they give good retention of this and since they also positively contribute to general retention of fibres and fillers and to dewatering effect at paper production. They also have good effect in the presence of retention/dewatering systems which are based on anionic inorganic colloids, such as silica based colloids, and cationic polymers.

The present invention thus relates to aqueous compositions of sizing agents which are hydrophobing cyclic dicarboxylic acid anhydrides or alkyl ketene dimers, which compositions comprise an amphoteric polymer, which is amphoteric starch or an amphoteric acrylamide based polymer, and a polyaluminium compound.

The two types of sizing agents are per se well known. Cyclic dicarboxylic acid anhydrides can be characterized by the general formula

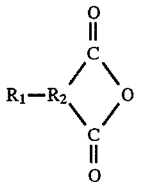

wherein $R_2$ is a dimethylene or trimethylene radical and $R_1$ is a hydrocarbon group having more than 7 carbon atoms and can be an alkyl, alkenyl, aralkyl or aralkenyl group. The cyclic dicarboxylic acid anhydrides which are used commercially to the greatest extent are alkyl and alkenyl succinic anhydrides (ASA) and particularly isooctadecenyl succinic anhydride.

Alkyl ketene dimers have the general formula

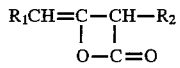

wherein $R_1$ and $R_2$ are hydrophobic hydrocarbon groups having about 6 to about 30 carbon atoms and which are usually alkyl groups having 12 to 20 carbon atoms, such as hexadecyl and octadecyl groups.

The amphoteric polymer in the present compositions are amphoteric starch or amphoteric acrylamide based polymer. The term amphoteric herein refers to polymers containing both anionic and cationic groups. Amphoteric starch is preferred and for this the anionic groups can for example be phosphate, phosphonate, sulphate, sulphonate or carboxylic acid groups and they are preferably phosphate groups. The cationic groups are tertiary amino groups or quaternary ammonium groups. The ratio between the number of anionic and cationic groups in the starch can be within the range 0,025:1 to 90:1, and is preferably within the range 0.4:1 to 40:1. Any starch which contains both these types of groups can be used and the starch itself can thus originate from potatoe, corn, wheat, tapioca, rice, waxy maize etc. The anionic groups in the starch can be native and/or introduced by chemical treatment of the starch. It is particularly suitable to use cationized potato starch since native potato starch contains a substantial amount of covalently bound phosphate monoester groups.

The amphoteric polymer can also be an acrylamide based polymer, which are water soluble polymers with acrylamide and/or methacrylamide as the main monomeric unit. These polymers can have molecular weights from about 10000 to about 1500000, suitably from about 300000 to about 800000. Amphoteric acrylamide based polymers can be prepared by introduction of ionic groups in a polymer containing (meth) acrylamide as the main component. Cationic groups can be introduced by different methods such as Hofmann-degradation and Mannich reaction and anionic groups can for example be introduced by hydrolysis or sulphomethylation reaction. Amphoteric acrylamide based polymers can also be prepared by co-polymerisation of (meth) acrylamide and a monomer mixture containing both anionic and cationic monomers.

In the present compositions both an amphoteric polymer and a polyaluminium compound are included. It is believed that there is a certain interaction between the anionic groups in the amphoteric polymer and the polyaluminium compounds which contributes to a good stabilisation of the compositions and good retention of the sizing agent in the stock.

Ketene dimers are the preferred sizing agents. Aqueous AKD-dispersions which comprise both an amphoteric polymer and a polyaluminium compound give very good sizing with low amounts of AKD and the dispersions further have satisfactory stability and can be produced with sufficiently high dry contents for commercial use. The dispersions also have good effect in the presence of retention/dewatering systems which are based on combinations of anionic inorganic colloids, such as silica based colloids, and cationic polymers. It also seems that the dispersions as such can contribute to an improvement of dewatering and general retention of fibres and optional fillers.

Polyaluminium compounds are based on aluminium, hydroxy groups and anions, they are termed basic and in aqueous solutions they are polynuclear complexes. Polyaluminium compounds such as polyaluminium chloride and polyaluminium chloride containing sulphate are in themselves well-known compounds and have in connection with paper been used, among other things, at rosin sizing for fixation of the rosin by formation of aluminium-rosin complex.

As examples of suitable compounds can be mentioned polyaluminium compounds having the general formula $$Al_n(OH)_mX_{3n-m}$$

wherein X is a negative ion such as chloride or acetate and both n and m are positive integers so that $3_{n-m}$ is greater than 0. Preferably $X=Cl^-$ and such polyaluminium compounds are known as polyaluminium chlorides (PAC). Polyaluminium chlorides can also contain anions from sulphuric acid, phosphoric acid, polyphosphoric acid, chromic acid, dichromic acid, silicic acid, citric acid, carboxylic acids or sulphonic acids.

The basicity of polyaluminium compounds of the above given formula is defined as the ratio m/3n*100. The basicity is suitably within the range from 10 up to 90% and preferably within the range from 20 up to 85%.

The most suitable polyaluminium compounds in the present compositions are polyaluminium chlorides, polyaluminium chlorides containing sulphate and polyaluminium sulphates. As examples of polyaluminium sulphates can be mentioned those with the formula $[Al(OH)_x(SO_4)_y(H_2O)_z]_n$ wherein x has a value of 1.5 to 2.0, y a value of 0.5 to 0.75, x+2y=3 and z=1.5–4, suitably 1.5–3.0. The term polyaluminium compounds is herein used to encompass also mixtures and co-condensates of cationic dicyandiamide resins and polyaluminium compounds. Such products are disclosed in the European patent application 320986.

An example of a commercially available polyaluminium compound is Ekoflock, produced and sold by Eka Nobel AB in Sweden. In this case the basicity is about 25% and the content of sulphate and aluminium about 1.5 and 10 per cent by weight, respectively, whereby the content of aluminium is counted as $Al_2O_3$. In aqueous solutions the dominating complex is $Al_3(OH)_4^{5+}$ transformed into $Al_{13}O_4(OH)_{24}^{7+}$.

Other examples of commercially available compounds are the sulphate-free Sachtoklar®, sold by Sachtleben Chemie in Germany, the sulphate-containing WAC sold by Atochem in France, the highly basic polyaluminium chloride compound Locron sold by Hoechst AG in Germany, poly(hydroxyaluminium) sulphate Omniklir, sold by OmniKem, USA, Niaproof, which is an aluminium hydroxy acetate, sold by Niacet in the USA and Alzofix which is based on polyaluminium chloride and dicyandiamide, sold by SKW Trostberg, Germany.

In the ketene dimer dispersions according to the present invention the amphoteric polymer is suitably present in amounts of from 1 to 35% by weight, based on the ketene dimer. The amount is preferably within the range of from 5 to 20. The polyaluminium compound is present in comparatively high amounts and suitably in an amount of from 0.1 to 10% by weight, calculated as $Al_2O_3$ on the ketene dimer, and preferably the amount of polyaluminium compound is within the range of from 1 to 6% by weight. Despite the high amounts of aluminium compound the dispersions show good stability. Dispersions according to the present invention can have AKD contents of from about 5% by weight up to about 30% by weight and the content of AKD is suitably within the range of from 10 to 20%.

Ketene dimer dispersions according to the present invention can be produced by mixing an aqueous solution of the amphoteric polymer with AKD-wax at a temperature of from about 55° C. to about 95° C. and homogenizing at this temperature under a pressure of from about 50 to about 500 bar. The obtained emulsion, which has a drop size of from about 0.3 to about 3μm, is then rapidly cooled and the polyaluminium compound is suitably added during or after the cooling. In addition to the three above mentioned essential components other components can also be incorporated into the dispersions, for example anionic surface active agents such as sodium lignosulphonate, extenders such as urea and urea derivatives etc.

Cyclic dicarboxylic acid anhydrides such as ASA are liquid at room temperature. In commercial ASA-products an emulsifier is usually present. Aqueous compositions of cyclic dicarboxylic acid anhydrides are emulsions and compositions according to the invention can be prepared by mixing the liquid acid anhydride with a solution of the amphoteric polymer, whereby the polyaluminium compound is present in the solution. The solution should be kept at a temperature of about 20° C. Compositions of cyclic dicarboxylic acid anhydrides according to the invention suitably contain the acid anhydride and the amphoteric polymer in a weight ratio of from 1:1 to 1:4. The polyaluminium compound is present in corresponding amounts, based on the cyclic dicarboxylic acid anhydride, as given for the ketene dimer dispersions. ASA-emulsions are normally produced at the paper mill in direct connection to its use as sizing agent at the paper production. Amounts of the acid anhydride of from about 0.1 to 5% by weight are then common.

The compositions according to the invention are used in a conventional manner at the production of paper. They can be used both for surface sizing and stock sizing at the production of paper, board and cardboard. The present invention also relates to a method for the production of paper using aqueous compositions of cyclic dicarboxylic acid anhydrides or alkyl ketene dimers containing amphoteric polymer and polyaluminium compound, as described above, as surface- or stock sizing agents. At stock sizing the composition are suitably added to an amount of AKD or cyclic dicarboxylic acid anhydride of 0.2 to 8 kg/ton of the dry content of the stock, ie fibres and optional fillers, where the dosage is mainly dependent on the quality of the paper.

The invention is further illustrated in the following examples which, however, are not intended to limit the same. Parts and per cent relate to parts by weight and per cent by weight respectively, unless otherwise stated.

EXAMPLE 1

Ketene dimer dispersions according to the invention were prepared as follows: 70 g of a potato starch cationized to a degree of substitution of 0.042 were mixed with 450 g of AKD-wax and about 2340 g of water containing 15 g of sodium lignosulphonate at a temperature of 75° C. and the mixture was homogenized at this temperature under a pressure of 200 bar and rapidly cooled. During the cooling a polyaluminium compound was added. For dispersion 1*a*) 120 g of a polyaluminium chloride containing sulfate, Ekoflock from Eka Nobel AB, were added. For dispersion 1*b*) 168 g of a polyaluminium sulphate, Omniklir from OmniKem, USA, corresponding to 2.8 per cent of $Al_2O_3$, were added. For dispersion 1*c*) 150 g of Alzofix P (dicyandiamide-polyaluminium condensate) from SKW Trostberg, Germany, corresponding to 2.8 per cent of $Al_2O_3$, were added.

EXAMPLE 2

Paper sheets were prepared from a standard stock of bleached sulphate pulp (48% birch, 32% pine and 20% calcium carbonate) at a pH of 8.0 according to the standard method SCAN-C23X for laboratory scale. In the table below Cobb-values, measured according to Tappi standard T 441 OS-63 are shown. In these tests Dispersion 1*a*) according to the invention was compared with a dispersion, Ref., containing cationic waxy maize starch and the same polyaluminium compound as in dispersion 1*a*) and the starch and the polyaluminium compound were present in the same amounts as in dispersion 1a).

| Dispersion no. | AKD kg/t | Cobb 60 g/m$^2$ |
|---|---|---|
| 1a) | 0.3 | 33 |
| 1a) | 0.4 | 25 |
| 1a) | 0.5 | 23 |
| 1a) | 0.6 | 22 |
| Ref. | 0.3 | 65 |
| Ref. | 0.4 | 30 |
| Ref. | 0.5 | 25 |
| Ref. | 0.6 | 25 |

As evident AKD-dispersions containing polyaluminium compound wherein the starch is amphoteric are considerably more effective than products wherein the starch contain only cationic groups.

EXAMPLE 3

The sizing effect of the dispersions 1*b*) and 1*c*) were investigated in the same manner as in Example 2 and the following results were obtained:

| Dispersion no. | AKD kg/t | Cobb 60 g/m$^2$ |
|---|---|---|
| 1b) | 0.3 | 34 |
| 1b) | 0.4 | 28 |
| 1b) | 0.5 | 24 |
| 1b) | 0.6 | 23 |
| 1c) | 0.3 | 30 |
| 1c) | 0.4 | 24 |
| 1c) | 0.5 | 24 |
| 1c) | 0.6 | 23 |

EXAMPLE 4

In this example edge penetration values were investigated for a 35% $H_2O_2$-solution by means of a so-called Edge Wick test. The tests were made on a stock from 100% CTMP-pulp from which paper having a basis weight of 150 g/m$^2$ were prepared at a pH of 7.6. In all tests alum, polyamidoamine wet-strength resin and a dewatering-retention system based on silica Sol and cationic starch were added to the stock separately from the AKD-dispersion. A comparison was made between dispersion 1*a*) according to the invention and a standard AKD-dispersion containing cationic waxy maize starch Ref. 1 and also with a dispersion corresponding to la) but not containing polyaluminium compound, Ref. 2.

| Dispersion | AKD kg/t | $H_2O_2$ kg/m$^2$ |
|---|---|---|
| 1a) | 1 | 3.35 |
| 1a) | 1.5 | 2.58 |
| 1a) | 2 | 1.49 |
| 1a) | 3 | 1.57 |
| Ref. 1 | 1 | 3.95 |
| Ref. 1 | 1.5 | 3.20 |
| Ref. 1 | 2 | 2.33 |
| Ref. 1 | 3 | 2.14 |
| Ref. 2 | 1 | 3.88 |
| Ref.2 | 1.5 | 3.06 |
| Ref. 2 | 2 | 2.30 |
| Ref. 2 | 3 | 2.14 |

As evident the dispersions according to the invention gave a clearly improved sizing in this respect in comparison with a standard product. It is also evident that this effect is not solely dependent on the type of starch but it is dependent on the combination of amphoteric starch and polyaluminium compound.

EXAMPLE 5

For the same stock as above dewatering tests were carried out in the presence of a commercial retention- and dewatering system, Compozil®, which comprises inorganic silica sol (Si-sol) and cationic starch (CS) which are added to the stock separately. The tests were made using this system in the presence of different ketene dimer dispersions and the dewatering effect was measured by means of a "Canadian Standard Freeness (CSF) Tester" which is the usual method for characterizing dewatering or drainage capacity according to SCAN-C 21:65. For O-test, stock without addition of either the retention-dewatering system (R-D system) or AKD-dispersions the dewatering capability was 310 ml CSF. Tests were made with dispersions 1*a*) and 1*b*) according to the invention and comparisons were made with a reference dispersion, a standard D-dispersion containing cationic waxy maize starch.

| Dispersion | AKD | RD system | | CSF |
|---|---|---|---|---|
| no. | kg/t | CS kg/t | Si-sol kg/t | ml |
| — | — | 4 | 1 | 550 |
| — | — | 6 | 1 | 580 |
| — | — | 8 | 1 | 575 |
| 1a) | 1 | 4 | 1 | 580 |
| 1a) | 1 | 6 | 1 | 615 |
| 1a) | 1 | 8 | 1 | 590 |
| 1b) | 1 | 4 | 1 | 570 |
| 1b) | 1 | 6 | 1 | 600 |
| 1b) | 1 | 8 | 1 | 590 |
| Ref. | 1 | 4 | 1 | 540 |
| Ref. | 1 | 6 | 1 | 575 |
| Ref. | 1 | 8 | 1 | 570 |

As can be seen the dispersions according to the invention gave an improvement of the dewatering effect while the reference dispersion gave a slight impairment of this.

We claim:

1. An aqueous sizing composition which comprises a sizing agent which is selected from the group consisting of cyclic dicarboxylic acid anhydride and alkyl ketene dimer, a stabilizing and/or dispersing agent which is an amphoteric polymer selected from the group consisting of amphoteric starch and amphoteric acrylamide based polymer, and a polyaluminum compound.

2. The composition of claim 1 wherein the amphoteric polymer is amphoteric starch.

3. The composition of claim 2 wherein the amphoteric starch is cationized potato starch.

4. The composition of claim 1 wherein the polyaluminium compound is polyaluminium chloride, sulphate-containing polyaluminium chloride, polyaluminium sulphate or a mixture or co-condensate of cationic dicyandiamide resin and a polyaluminium compound.

5. The composition of claim 4 wherein the polyaluminium compound is present in an amount of from 0.1 to 10% by weight, calculated as $Al_2O_3$ on the sizing agent.

6. The composition of claim 1 wherein the sizing agent is an alkyl ketene dimer.

7. The composition of claim 6 wherein the amphoteric polymer is present in an amount of from 1 to 35% by weight based on the ketene dimer.

8. The composition of claim 6 which comprises from about 5 to about 30% by weight ketene dimer.

9. A process for the production of paper, board or cardboard which comprises utilizing, as a sizing agent, the aqueous composition of claim 1.

10. An aqueous sizing composition which comprises at least one alkyl ketene dimer, at least one amphoteric starch as a dispersing and/or stabilizing agent for said alkyl ketene dimer, and at least one polyaluminum compound.

11. The composition of claim 10 wherein said amphoteric starch is cationized potato starch.

12. The composition of claim 10 wherein said polyaluminium compound is selected from the group consisting of polyaluminium chloride, sulphate-containing polyaluminium chloride, polyaluminium sulphate, and a mixture or co-condensate of cationic dicyandiamide resin and a polyaluminium compound.

13. The composition of claim 12 which comprises from about 5 to 30% by weight ketene dimer, from about 1 to 35% by weight amphoteric polymer based on ketene dimer; and from about 0.1 to 10% by weight of polyaluminium compound calculated as $Al_2O_3$ on the sizing agent.

14. A method for sizing paper, board or cardboard prepared from papermaking stock which comprises adding the composition of claim 10 to said papermaking stock prior to forming said papermaking stock into said paper, board or cardboard.

15. A method for sizing paper, board or cardboard which comprises applying the composition of claim 10 to the surface of said paper, board or cardboard.

16. The composition of claim 10 wherein the amphoteric starch contains cationic groups which are quaternary ammonium groups and anionic groups which are selected from the group consisting of phosphate, phosphonate, sulfate, sulphonate, and carboxylic acid groups.

* * * * *